United States Patent [19]

Nakajima

[11] Patent Number: 4,948,345

[45] Date of Patent: Aug. 14, 1990

[54] VARIABLE CAPACITY COMPRESSOR HAVING A WIDENED VARIABLE RANGE OF CAPACITY

[75] Inventor: Nobuyuki Nakajima, Konan, Japan

[73] Assignee: Diesel Kiki Corp., Ltd., Tokyo, Japan

[21] Appl. No.: 348,713

[22] Filed: May 8, 1989

[30] Foreign Application Priority Data

May 9, 1988 [JP] Japan ..... 63-111796

[51] Int. Cl.[5] ..... F04B 49/00

[52] U.S. Cl. ..... 417/295; 417/310

[58] Field of Search ..... 417/295, 310, 440; 418/78

[56] References Cited

U.S. PATENT DOCUMENTS 4,272,227 6/1981 Woodruff ..... 417/440
4,566,863 1/1986 Goto et al. ..... 417/295
4,715,792 12/1987 Nishizawa et al. ..... 417/295
4,744,732 5/1988 Nakajima et al. ..... 417/295
4,846,632 7/1989 Suzuki et al. ..... 417/295

*Primary Examiner*—Stephen M. Hepperle
*Attorney, Agent, or Firm*—Charles S. McGuire

[57] ABSTRACT

A variable capacity compressor having a cylinder defining compression spaces therein. A control element is rotatable substantially in response to the difference between low pressure supplied from a suction chamber and control pressure created from high pressure supplied from a discharge pressure chamber for varying compression starting timing in the compression spaces and hence the capacity of the compressor. A capacity-reducing valve is operable in response to the control pressure for causing pressure within the least one of the compression spaces to leak into a low pressure side when the control element is in such an extreme position as to minimize the capacity of the compressor, to thereby further retard the compression starting timing and hence reduce the compressor capacity.

7 Claims, 6 Drawing Sheets

VARIABLE CAPACITY COMPRESSOR HAVING A WIDENED VARIABLE RANGE OF CAPACITY

BACKGROUND OF THE INVENTION

This invention relates to a variable capacity compressor mainly adapted for use in an air conditioning system for automotive vehicles, and more particularly to a compressor of this kind which has a widened variable range of delivery quantity or capacity.

A variable capacity vane compressor of this kind has conventionally been proposed, e.g. by U.S. Pat. No. 4,744,732 assigned to the same assignee of the present application, which has a control element arranged in one of side blocks forming a cylinder in cooperation with a cam ring, for rotation in opposite directions in response to the difference between low pressure (or suction pressure) from a suction chamber and control pressure created from discharge pressure within a discharge pressure chamber and the suction pressure, to vary the compression starting timing in two diametrically opposite compression chambers defined between adjacent ones of vanes within the cylinder, thereby varying the delivery quantity or capacity of the compression chambers and hence the compressor.

According to the proposed variable capacity compressor, when the compressor is operating at a low rotational speed and accordingly the suction pressure of refrigerant gas as a compression medium is high, the control pressure is increased so that the control element is rotated against the sum of the suction pressure and the force of a coiled return spring biasing the control element in the direction of reducing the capacity, to thereby advance the compression starting timing, at which the compression chambers and the suction chamber are brought out of communication, and hence increase the capacity of the compressor.

On the other hand, when the rotational speed of the compressor increases and accordingly the suction pressure lowers, the control pressure is decreased so that the control element is rotated by the sum of the suction pressure and the force of the coiled return spring in the opposite directiOn to the above, to thereby retard the compression starting timing and hence decrease the capacity of the compressor.

The control element has diametrically opposite cut-out portions, through which the associated compression chambers and the suction chamber are brought into communication with each other. When each vane passes a downstream end of each cut-out portion with respect to the rotational direction of the rotor, the compression chamber and the suction chamber are brought out of communication from each other to start the compression stroke.

The proposed compressor constructed as above has a limited variable range of capacity such that the lower limit of capacity, i.e. the minimum capacity is 10 percent provided that the upper limit or the maximum capacity is 100 percent. To obtain a wider controllable range of temperature, it is desirable that the variable range of capacity should be widened. However, the maximum angle through which the control element can rotate is no more than 65 to 70 degrees due to structural limitation of the compressor. To obtain a wider variable range of capacity, the minimum capacity has to be reduced to a value as small as possible. However, in the proposed compressor, if the cut-out portion is formed in the control element so that its downstream end is located further downstream with respect to the rotational direction of the rotor so as to obtain a wider variable range of capacity, the timing at which the compression chamber is brought out of communication from the suction chamber is correspondingly retarded to decrease the suction efficiently during the full capacity operation, thereby lowering the maximum capacity of the compressor.

Further, if the minimum capacity is excessively decreased, a required compression ratio for starting the compressor cannot be obtained at the start of the compressor, thereby degrading the startability of the compressor.

SUMMARY OF THE INVENTION

It is an object of the invention to provide a variable capacity compressor which is capable of reducing the minimum capacity during partial capacity operation, while maintaining sufficient maximum capacity during full capacity operation, thereby obtaining a widened variable range of capacity.

Another object of the invention is to reduce the minimum capacity without spoiling the startability of the compressor.

To achieve the above objects, the present invention provides a variable capacity compressor having a suction chamber, a discharge pressure chamber, a cylinder defining at least one compression space therein, a control element being rotatable substantially in response to a difference between low pressure supplied from the suction chamber and control pressure created from high pressure supplied from the discharge pressure chamber for varying compression starting timing in the at least one compression space and hence the capacity of the compressor.

The variable capacity compressor according to the present invention is characterised by an improvement comprising capacity-reducing means being operable in response to the control pressure for causing pressure within the at least one compression space to leak into a low pressure side when the control element is in such an extreme position as to minimize the capacity of the compressor.

The above and other objects, features and advantages of the invention will become more apparent from the ensuing detailed description taken in conjunction with the accompanying drawings.

DETAILED DESCRIPTION

Figure 1:
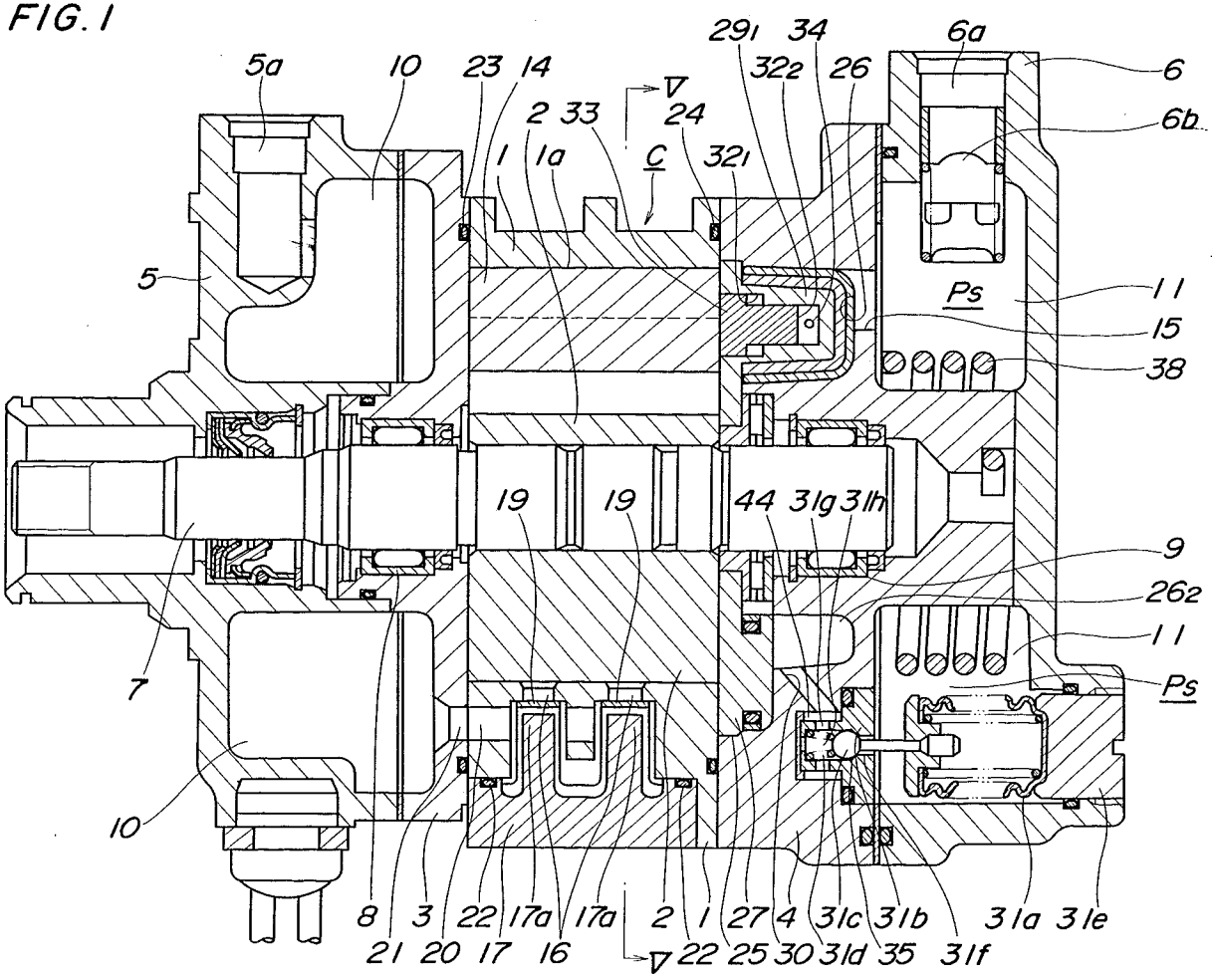
FIG. 1 is a longitudinal cross-sectional view of a variable capacity vane compressor according to a first embodiment of the invention.

The invention will now be described in detail with reference to the drawings, showing embodiments thereof. Corresponding elements and parts are designated by identical reference numerals throughout all the figures.

FIGS. 1 through 7 show a variable capacity vane compressor according to a first embodiment of the invention.

Figure 5:
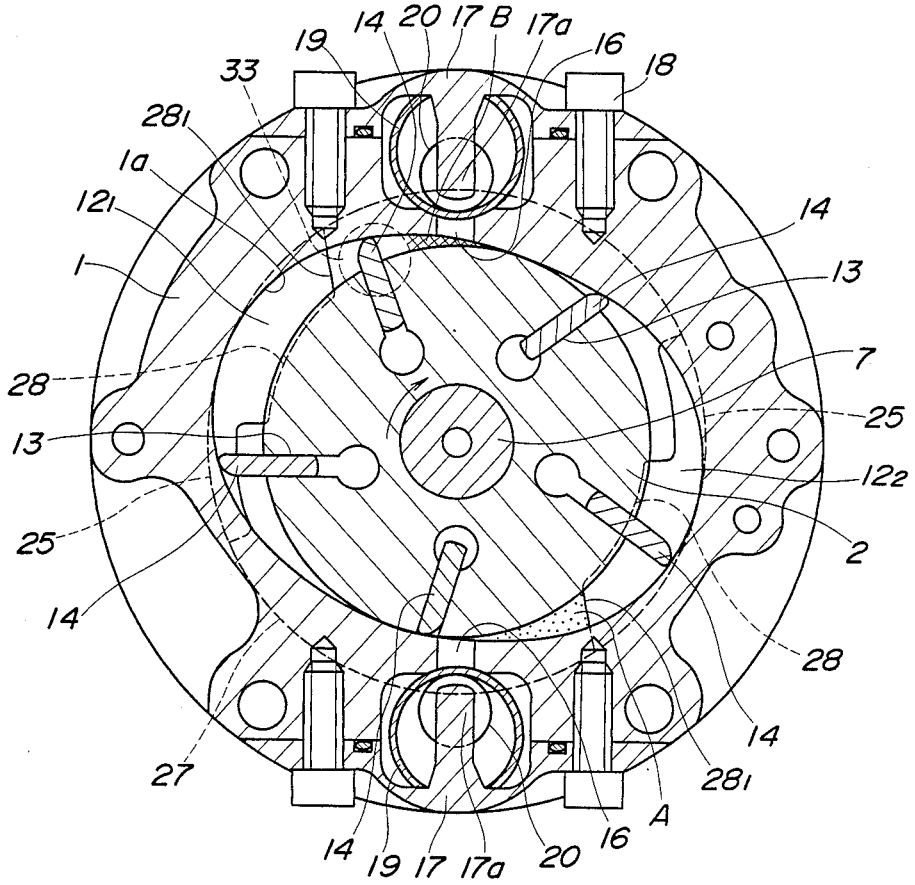
FIG. 5 is a transverse cross-sectional view taken along line V—V in FIG. 1, wherein the compressor is in partial capacity operation.

Referring first to FIGS. 1 and 5, the variable capacity vane compressor is composed mainly of a cylinder C formed by a cam ring 1 having an inner peripheral camming surface !a with a generally elliptical cross section, and a front side block 3 and a rear side block 4 closing open opposite ends of the cam ring 1, a cylindrical rotor 2 rotatably received within the cylinder C, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

As shown in FIG. 5, a pair of compression spaces $12_1$, $12_2$ are defined at diametrically opposite locations between the inner peripheral camming surface 1*a* of the cam ring 1, the outer peripheral surface of the rotor 2, an end face of the front side block 3 on the cam ring 1 side, and an end face of a control element 27 on the cam ring 1 side.

The rotor 2 has its outer peripheral surface formed therein with a plurality of (five in the illustrated embodiment) axial vane slits 13 at circumferentially equal intervals, in each of which a vane 14 is radially slidably fitted.

Refrigerant inlet ports 15, 15 are formed in the rear side block 4 at diametrically opposite locations, though only one of which is shown in FIG. 1. These refrigerant inlet ports 15, 15 are located at such locations that they become closed when a compression chamber defined between successive two vanes 14 assume the maximum volume. These refrigerant inlet ports 15, 15 axially extend through the rear side block 4 and through which the suction chamber 11 and the compression spaces $12_1$ and $12_2$ are communicated with each other.

Plural pairs of e.g., two pairs of, refrigerant outlet ports 16, 16, each port having two openings, are formed through opposite lateral side walls of the cam ring 1 at diametrically opposite locations, as shown in FIGS. 1 and 5. The cam ring 1 has opposite lateral side walls thereof provided with respective discharge valves !9, 19, which open in response to pressure within the respective compression chambers to thereby open the refrigerant outlet ports 16, 16. Further formed in the cam ring 1 are a pair of passages 20, only one of them being shown, which each communicate with a corresponding one of the refrigerant outlet parts 16, 16 when the discharge valve 19 opens. A pair of passages 21, only one of which are shown, are formed in the front side block 3, which each communicate with a corresponding one of the passages 20, whereby when the discharge valves 19 open to thereby open the refrigerant outlet ports 16, a compressed refrigerant gas in the compression chamber 12 is discharged through the discharge port 5*a* via the refrigerant discharge outlet ports 16, the passages 20 and 21, and the discharge pressure chamber 10, in the mentioned order.

As shown in FIGS. 1 and 5, the rear side block 4 has an end face facing the rotor 2, in which is formed an annular recess 25. A pair of pressure working chambers 26, 26 are formed in a bottom of the annular recess 25 at diametrically opposite locations.

Figure 7:
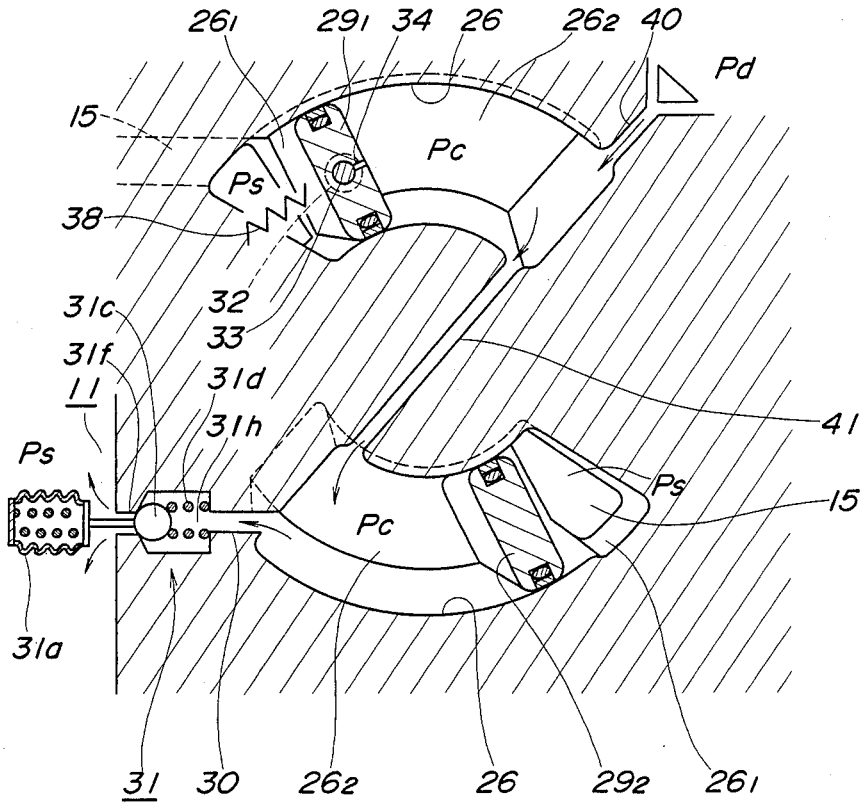
FIG. 7 is a view useful for explaining the operation of a capacity control device of the compressor of FIG. 1.

A control element 27, which is in the form of an annulus, is received in the annular recess 25 for rotation about its own axis in opposite circumferential directions. The control element 27 has its outer peripheral edge formed with a pair of diametrically opposite arcuate cut-out portions 28, 28. When each vane 14 passes the downstream end $28_1$, 281 of the cut-out portion 28, 28 with respect to rotational direction of the rotor 2, the associated compression chamber and the suction port 15, 15 are brought out of communication to start the compression stroke. The respective downstream ends 281, 281 of the cut-out portion 28, 28 are at such a location that the corresponding compression chamber has a minimum volume required for starting of the compressor. The control element has its one side surface formed integrally with a pair of diametrically opposite pressure-receiving protuberances $29_1$, $29_2$ axially projected therefrom and acting as pressure-receiving elements. The pressure-receiving protuberances $29_1$, $29_2$ are slidably received in respective pressure working chambers 26, 26. As shown in FIG. 7, the interior of each of the pressure working chambers 26, 26 is divided into a first pressure chamber (low-pressure chamber) $26_1$ and a second pressure chamber (high-pressure chamber) $26_2$ by the associated pressure-receiving protuberance $29_1$, $29_2$. Each of the first pressure chambers $26_1$, $26_1$ communicates with the suction chamber 11 through the corresponding inlet port 15 to be supplied with the refrigerant gas with suction pressure Ps or low pressure.

One of the second pressure chambers $26_2$, $26_2$ communicates with the passage 20 via a restriction passage 40. These second pressure chambers $26_2$, $26_2$ are communicated with each other by way of a passage 41 so that discharge pressure Pd is supplied into the both chambers $26_2$, $26_2$ to create control pressure Pc therein.

The one second pressure chamber $26_2$ is communicatable with the suction chamber 11 via a passage 30 extending between the chamber $26_2$ and the suction chamber 11 and a control valve device 31, both provided in the rear side block 4, as shown in FIGS. 1 and 7.

The control valve device 31 is operable in response to suction pressure Ps prevailing within the suction chamber 11 and comprises a flexible bellows 31*a* as a pressure-responsive element, a valve casing 31*b*, a ball valve body 31*c*, a coiled spring 31*d* urging the ball valve body 31*c* in its closing direction. The bellows 31*a* is disposed within the suction chamber 11 for expansion and contraction in response to the pressure Ps therein. The valve casing 31*b* is fitted in a valve-receiving space 44 which is formed in the rear side block 4 in communicatiOn with the passage 30. With such arrangement, when the suction pressure Ps within the suction chamber 11 is above a predetermined value set by an adjusting screw member 31e, the bellows 31a is in a contracted state to bias the ball valve body 31c in a position closing a central hole 31f formed through the valve casing 31b. On the other hand, when the suction pressure Ps is below the predetermined value, the bellows 31a is in an expanded state to bias the ball valve body 31c in a position opening the central hole 31f. In this open position of the valve, the aforementioned one second pressure chamber $26_2$ is communicated with the suction chamber 11 via the passage 30, the valve-receiving space 44, a pair of radial holes 31g formed in the valve casing 31b, a chamber 31h defined within the valve casing 31b, and the central hole 31f.

The control element 27 is urged in the clockwise direction as viewed in FIG. 7 by a torsion coiled spring (return spring) 38 fitted around a hub of the rear side block 4 axially extending toward the suction chamber 11, as shown in FIGS. 1 and 7.

Figure 6:
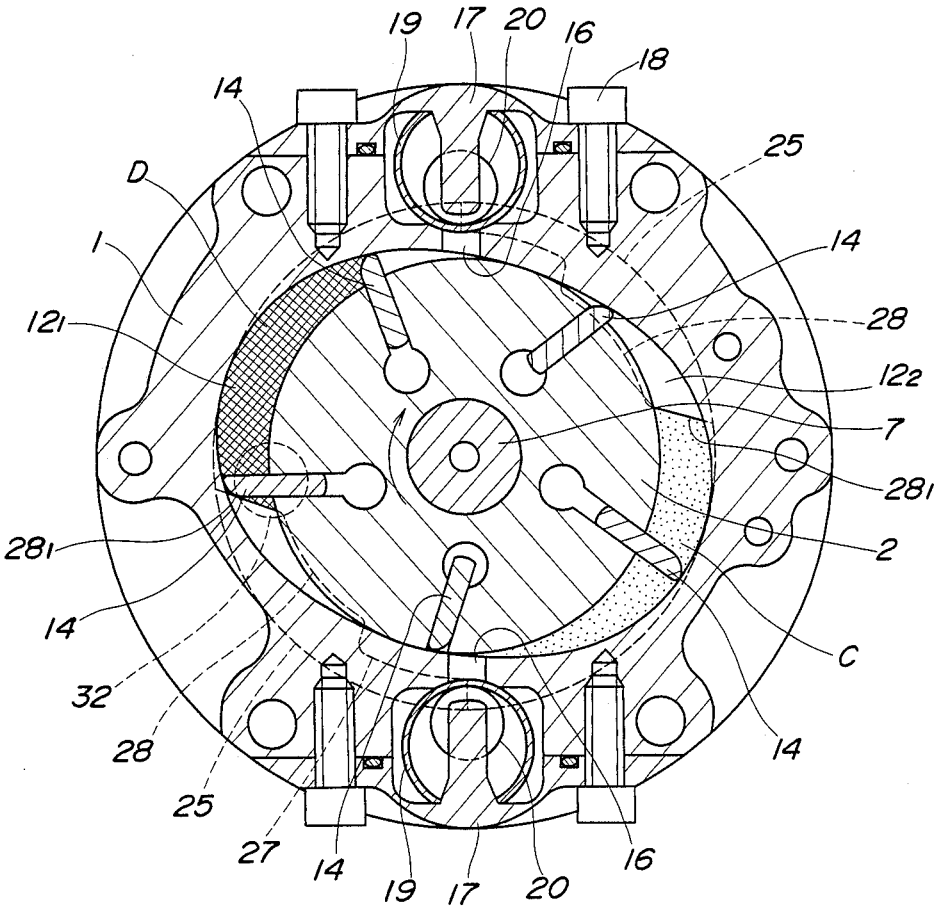
FIG. 6 is a view similar to FIG. 5, wherein the compressor is in full capacity operation.

Thus, the control element 27 is rotatable in opposite directions in response to the difference between the sum of the suction pressure Ps introduced into the first pressure chambers $26_1$, $26_1$ and the urging force of the coiled spring 38, and the control pressure Pc within the second pressure chambers $26_2$, $26_2$. To be specific, the control pressure Pc within the second pressure chambers $26_2$, $26_2$ is controlled by means of the control valve device 31 so as to maintain the suction pressure Ps at the predetermined value so that the control element 27 is rotated in opposite directions between two extreme positions, i.e., the maximum capacity position for obtaining the maximum delivery quantity or capacity of the compressor, as shown in FIG. 6, and the minimum capacity position for obtaining the minimum delivery quantity or capacity of the compressor, as shown in FIG. 5.

Figure 2:
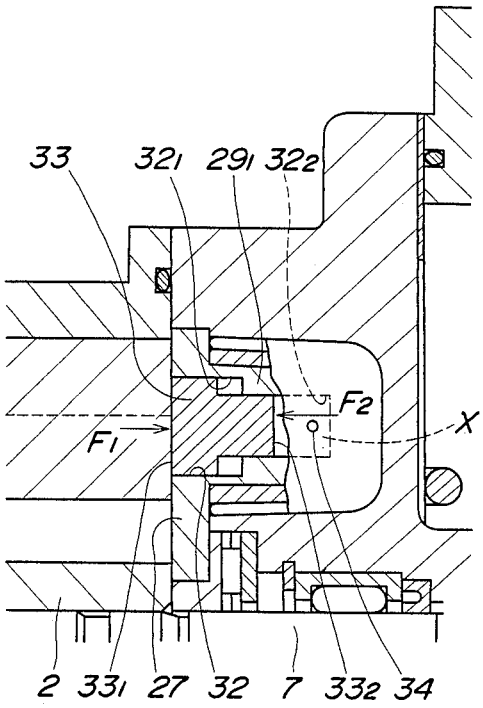
FIG. 2 is an enlarged sectional view showing a capacity-reducing valve of the compressor of FIG. 1 when it is closed.
Figure 3:
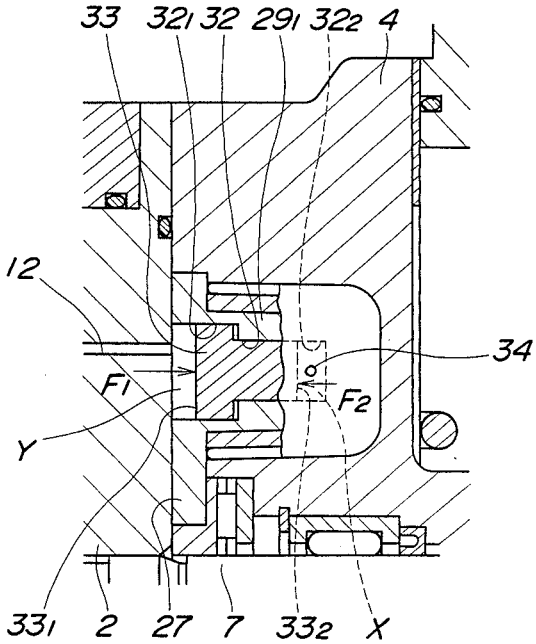
FIG. 3 shows the capacity-reducing valve of FIG. 2 when it is open.
Figure 4:
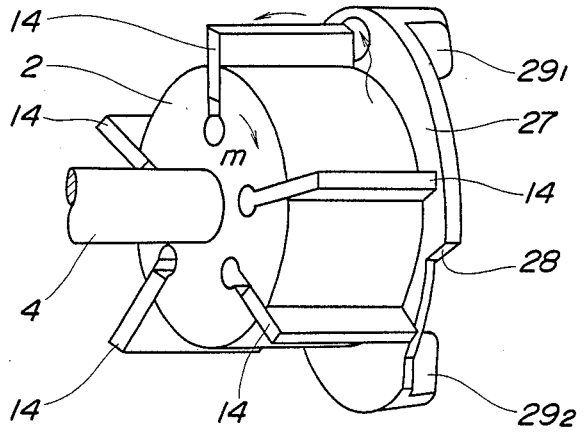
FIG. 4 is a perspective view of a rotor, vanes, and a control element of the compressor.

FIGS. 2 and 3 show a capacity-reducing valve according to a first embodiment of the invention. A spool chamber (valve bore) 32 is axially formed in one of the pressure receiving protuberances $29_1$ of the control element 27. The spool chamber 32 has a larger diameter portion $32_1$ opening in one end face of the control element 27 facing the rotor 2, and a smaller diameter portion $32_2$ in the form of a blind hole continuous with the larger diameter portion $32_1$. Axially slidably received within the spool chamber 32 is a spool (valve body) 33 which has a larger diameter portion and a smaller diameter portion slidably fitted, respectively, within the larger diameter portion $32_1$ and the smaller diameter portion $32_2$. As best shown in FIG. 7, a communication passage 34 is formed in the one pressure-receiving protuberance $29_1$ with one end thereof opening into the smaller diameter portion $33_2$ of the spool chamber 32 and the other end opening into the second pressure chamber $26_2$, for introducing the control pressure Po within the second chamber $26_2$ into a space X within the smaller diameter portion $33_2$.

With the above construction of the capacity-reducing valve, as shown in FIG. 2, a force F1 of pressure of the compressed gas within the associated compression chamber $12_1$ (hereinafter referred to as "the compression force") acts on an end face of the spool 33 facing the rotor 2 to urge same in the direction away from the rotor 2, whereas a force F2 of the control pressure Pc within the smaller diameter portion $33_2$ acts on the other end face of the spool 33 remote from the rotor 2 to urge same in the direction toward the rotor 2. The force F2 is expressed as $F2 = Pc \times S$ where S represents the effective pressure-receiving area of the other end face of the spool 33. The spool 33 is axially displaced within the spool chamber 32 in response to the difference between the force F1 and the force F2 between two extreme positions. i.e.. a position closer to the rotor 2 and a position remote from the rotor 2. When the spool 33 is in the extreme position remote from the rotor 2, a space Y is defined within the spool chamber 32 between the end face of the spool 33 facing the rotor 2 and the opposed end face of the rotor 2, and then part of the compressed gas within the associated compression chamber is allowed to leak between through the vane and the space Y into the immediately following compression chamber, as shown by the arrow in FIG. 4.

The operation of the compressor according to the invention constructed as above will now be explained.

At the start of the compressor, almost no discharge pressure Pd is created by the compressor and accordingly the control pressure Pc is so low that the capacity-reducing valve 33 is in an open state. As a result, in the compression space $12_1$ associated with the capacity-reducing valve, part of the compressed gas within the compression chamber leaks between the vane and the space Y into the immediately following compression chamber. However, since in the other compression space $12_2$, it is so designed that the effective compression volume of the compression chamber on the compression stroke assumes a minimum required value for ensuring starting of the compressor, as shown by the dotted area A in FIG. 5, thereby enabling effective compression even at the start of the compressor.

Shortly after the start Of the compressor that is, when the rotational speed of the compressor is still low and the suction pressure Ps within the suction chamber 11 is above the aforementioned predetermined value the bellows 31a of the control valve device 31 is in a contracted state so that the ball valve body 31c closes the central hole 31f of the valve casing 31b, as shown in FIG. 1. Consequently, the control pressure Pc within the second pressure chambers $26_2$, $26_2$ into which the discharge pressure Pd is supplied through the restriction passage 40, is maintained at a high level, whereby the control pressure Pc is so high as to overcome the sum of the pressure Ps within the first pressure chambers $26_1$, $26_1$ and the force of the coiled spring 38, thereby rotating the control element 27 toward the full capacity position as shown in FIG. 6. In the full capacity position, the control element 27 assumes such a position that the downstream end $28_1$ of each cut-out portion 28 thereof with respect to the rotational direction of the rotor 2 is in an extreme upstream position, i.e., an extreme counterclockwise position of the control element 27 as viewed in the same figure, whereby the compression stroke commences at the earliest timing. Therefore, the volume of the refrigerant gas trapped within the compression chamber defined between the two successive vanes 14, 14 is the maximum, resulting in the maximum delivery quantity or capacity of the compressor.

On this occasion, as mentioned above, the control pressure Pc within the second pressure chambers $26_2$, $26_2$ is so high that the force F2 of the control pressure Pc within the space X, supplied from the second pressure chamber $26_2$ through the communication passage 34, overcomes the compression force F1, which acts on the spool 33 on the space Y side, to thereby displace the spool 33 into the extreme position toward the rotor 2, i.e. a valve closed position, as shown in FIG. 2. Thus, in the full capacity position of the control element 27 shown in FIG. 6, no space Y is defined within the spool chamber 32 so that the compressed gas within the associated compression chamber on the compression stroke is prevented from leaking into the immediately following compression chamber, thereby maintaining substantially the same compression starting timing in the one compression space $12_1$ as that in the other compression space $12_2$, as shown by the areas C and D in FIG. 6, and hence obtaining the maximum capacity of the compressor.

On the other hand, as the rotational speed of the compressor increases, the low pressure Ps within the low pressure chamber 11 decreases below the predetermined value and therefore the bellows 31*a* of the control valve device 31 is brought into an expanded state so that the ball valve body 31*c* opens the central hole 31*f* of the valve casing 31*b*. Consequently, refrigerant gas within the second pressure chambers $26_2$, $26_2$ flows through the passage 30, the valve-receiving space 44, the radial holes 31*g* of the valve casing 31*b*, the chamber 31*h* within the valve casing 31*b*, and the central hole 31*f* of the valve casing 31*b*, in the mentioned order, into the suction chamber 11. As a result, the control pressure Pc within the second pressure chambers $26_2$, $26_2$ decreases below the sum of the pressure Ps within the first pressure chambers $26_1$, $26_1$ and the urging force of the coiled spring 38, thereby rotating the control element 27 from the aforementioned maximum capacity position toward the partial capacity position as shown in FIG. 5.

In the partial capacity position, the control element 27 assumes such a position that the downstream end $28_1$ of each cut-out portion 28 is in an extreme downstream position, whereby the compression stroke commences at the most retarded timing. Therefore, the volume of the refrigerant gas trapped within the compression chamber defined between the two successive vanes 14 is the minimum, resulting in the minimum delivery quantity or capacity of the compressor.

On this occasion, the capacity-reducing valve 33, i.e., the one pressure-receiving protuberance $29_1$ of the control element 27, is positioned slightly downstream of the downstream end $28_1$ of the associated cut-out portion 28 with respect to the rotational direction of the rotor 2. Further, the control pressure Pc within the second pressure chambers $26_2$, $26_2$ is so low, i.e., at a value almost equal to the suction pressure Pc ($Pc \approx Ps$), that the force F2 of the control pressure Pc within the spece X, which pressure is supplied from the second pressure chamber $26_2$ through the communication passage 34, is surpassed by the contracting force F1 acting on the spool 33, to thereby displace the spool 33 into the extreme position remote from the rotor 2, i.e. a valve open position, as shown in FIG. 3. Thus, in the partial capacity position of the control element 27 shown in FIG. 5, the space Y is defined within the spool chamber 32 so that the compressed gas within the associated compression chamber on the compression stroke is allowed to leak into the immediately following compression chamber, thereby further retarding the compression starting timing in the one compression space $12_1$, which is normally determined by the downstream side edge of the space Y with respect to the rotational direction of the rotor 2, by a time period almost corresponding to the circumferential length or diameter of the spool chamber 32, as compared with the compression starting timing in the other compression space $12_2$. Therefore, in the partial capacity position, i.e., minimum capacity position, of the control element 27 shown in FIG. 5, the capacity in the one compression space $12_1$ (the area B in FIG. 5) is decreased below that in the other compression space $12_2$ (the area A in FIG. 5), thereby further reducing the total minimum capacity of the compressor.

Figure 8:
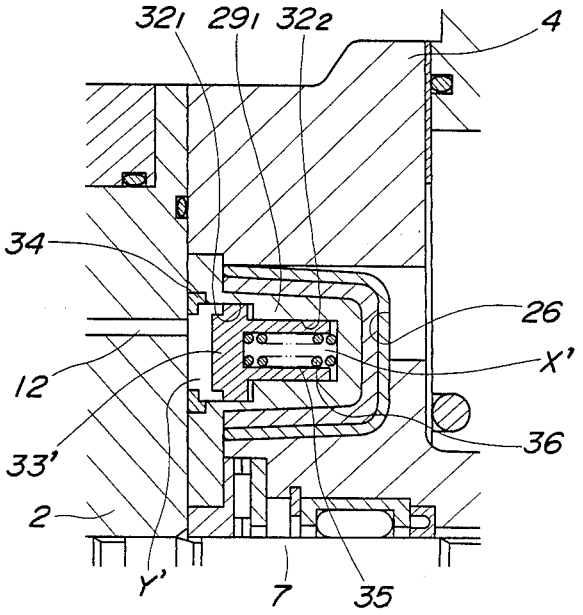
FIG. 8 is a view similar to FIG. 2, according to a second embodiment of the invention.

FIG. 8 shows a capacity-reducing valve according to a second embodiment of the invention. The second embodiment is different in structure from the first embodiment in that a spool 33' has an axial spring-receiving bore 35 formed therein, in which a coiled spring 36 is received for urgingly biasing the spool 33' toward the rotor 2, and an annular stopper 34 is fitted in the peripheral edge of the opening end of the spool chamber 32 facing the rotor 2, against which the peripheral edge of the end face of the spool 33' facing the rotor 2 can abut. A stopper like the stopper 34 of the second embodiment may also be provided in the capacity-reducing valve of the first embodiment.

In the capacity-reducing valve constructed as above, the spool 33' is axially displaced within the spool chamber 32 in response to the difference between the force F1' of compression medium acting thereon at the end face thereof on the space Y side and the sum of the force F2' of the control pressure Pc acting thereon at the end face thereof on the space X side ($F2' = Pc \times S'$; S' denotes the effective pressure-receiving area of the end face of the spool 33' on the space X side) and a force F3 of the coiled spring 36, between two extreme positions. i.e.. an extreme position toward the rotor 2 and an extreme position remote from the rotor 2, similarly to the first embodiment.

With such arrangement, when the compression force F1' is larger than the sum of the force F2' of the control pressure Pc and the force F3 of the coiled spring 36, i.e., $F1' > F2' - F3$, the spool 33' assumes the extreme position remote from the rotor 2 to define a space Y' within the spool chamber 32 so that part of the compressed gas within the associated compression chamber is allowed to leak between the vane and the space Y' into the immediately following compression chamber, similarly to the first embodiment. On the other hand, when the compression force F1' is smaller than the sum of the force F2' of the control pressure Pc and the force F3 of the coiled spring 36, i.e., $F1' < F2' - F3$, the spool 33' assumes the extreme position toward the rotor 2 side and no space Y' is defined within the spool chamber 32 so that the compressed gas within the associated compression chamber is prevented from leaking into the immediately following compression chamber, similarly to the first embodiment.

In the second embodiment, the use of the coiled spring 36 improves the startability Of the compressor. Specifically, at the start of the compressor, the relationship $F1' < F2' - F3$ stands, because the force F2' of the control pressure Pc is larger than the force F1', and the force F3 of the coiled spring 36 additionally acts on the spool 33' against the force F1'. As a result, the capacity-reducing valve is closed to prevent the compression gas within the associated compression chamber from leaking into the immediately following one, thereby enabling to promptly start compression, at the start of the compressor.

In the full capacity position of the control element 27, like the first embodiment, the control pressure Pc created within the second pressure chamber $26_2$, $26_2$ is so high that the sum of the force F2' of the control pressure Pc acting on the spool 33' at the end face on the space X' side and the force F3 of the coiled spring 36 overcomes the force F1' of compressed refrigerant acting on the spool at the end face on the rotor 2 side so that the spool 33' is displaced into the extreme position on the rotor 2 side. Thus, a space Y' is defined within the spool chamber 32 so that the compressed gas within the compression chamber on the compression stroke is allowed to leak into the immediately following compression chamber, thereby further retarding the compression starting timing in the one compression space $12_1$, as compared with the compression starting timing in the other compression space $12_1$.

On the other hand, in the partial capacity position of the control element 27, the control pressure Pc within the second pressure chambers $26_2$, $26_2$ is so low, i.e., at a value almost equal to the suction pressure Ps ($Pc \approx Ps$), that the sum of the force F2' of the control pressure Pc acting on the spool 33' at the end face on the space X' side and the force F3 of the coiled spring 36 is surpassed by the force F1' acting on the spool 33 on the space Y' side, to thereby displace the spool 33 into the extreme position remote from the rotor 2. As a result, a space Y' is defined within the spool chamber 32 so that the compressed gas within the compression chamber on the compression stroke leaks between the vane and the space Y' into the immediately following compression chamber, thereby further retarding the compression starting timing in the one compression space $12_1$ by a time period almost corresponding to the circumferential length or diameter of the spool chamber 32, as compared with the other compression space $12_2$.

In the second embodiment, two capacity-reducing valves may be provided in both of the compression spaces $12_1$ and $12_2$ without spoiling the startability of the compressor.

Further, in the first and second embodiments described above, the capacity-reducing valve is not limited to the spool type as described above, but it may be any other type insofar as it is capable of exhibiting a similar or equivalent function to that described above.

Moreover, in the first and second embodiments, although the capacity-reducing valve is provided in one of the pressure-receiving protuberances, the present invention is not limited to this, but, alternatively, a valve body such as a spool may be arranged in a valve bore formed in the cam ring and opening in the inner peripheral surface thereof such that the valve body is operable in response to the control pressure Pc supplied through a suitable communication passage. Alternatively, a valve body such as a spool may be arranged within a valve bore formed in the side block other than the side block provided with the control element, e.g., in the front side block in the case of the arrangement of FIG. 1, such that the valve body is operable in response to the control pressure Pc supplied through a suitable communication passage.

In these alternative examples, the capacity-reducing valve should be arranged at such a location at which the compression stroke commences in a compression chamber with the control element positioned in the partial capacity position.

What is claimed is:

1. In a variable capacity compressor having a suction chamber, a discharge pressure chamber, a cylinder defining at least one compression space therein a control element being rotatable substantially in response to a difference between low pressure supplied from said suction chamber and control pressure created from high pressure supplied from said discharge pressure chamber for varying compression starting timing in said at least one compression space and hence the capacity of said compressor, the improvement comprising capacity-reducing means being operable in response to said control pressure for causing pressure within said at least one compression space to leak into a low pressure side when said control element is in such an extreme position as to minimize the capacity of said compressor.

2. A variable capacity compressor as claimed in claim 1, wherein said control element has at least one pressure-receiving portion defining a first chamber supplied with said low pressure from said suction chamber and a second chamber in which said control pressure is created, said at least one pressure-receiving portion being rotatable in response to said difference between said low pressure within said first chamber and said control pressure within said second chamber, for causing rotation of said control element, said capacity-reducing means being arranged within said at least one pressure-receiving portion.

3. A variable capacity compressor as claimed in claim 2, wherein said capacitY-reducing means comprises a valve bore formed in said at least one pressure-receiving portion and having one end thereof opening in one end face of said pressure-receiving portion facing said at least one compression space, a valve body slidably received within said valve bore and having one end face remote from said at least one compression space, and passage means for supplying said valve bore with said control pressure acting on said one end face of said valve body.

4. A variable capacity compressor as claimed in claim 2, wherein said capacity-reducing means comprises a valve bore formed in said at least one pressure-receiving portion and having one end thereof opening in one end face of said pressure-receiving portion facing said at least one compression space, a valve body slidably received within said valve bore and having one end face remote from said at least one compression space, passage means for supplying said valve bore with said control pressure acting on said one end face of said valve body, and a spring arranged within said valve bore for always urging said one end face of said valve body.

5. A variable capacity compressor as claimed in claim 3 or claim 4, including valve means for decreasing said control pressure when said low pressure within said suction chamber is lower than a predetermined value, and increasing said control pressure when said low pressure within said suction chamber is higher than said predetermined value.

6. A variable capacity compressor as claimed in any of claims 2 to 4, including a rotor rotatably received within said cylinder, and a plurality of vanes carried by said rotor, said control element having at least one cut-out portion formed therein, said at least one cut-out portion having a downstream end with respect to rotational direction of said rotor, and wherein a compression stroke is started in associated One of said at least one compression space when each of said vanes passes said downstream end of each of said at least one out-out portion, said at least one pressure-receiving portion each being arranged slightly downstream of said downstream end of associated one of said at least one out-out portion.

7. In a variable capacity compressor having a suction chamber, a discharge pressure chamber, a cylinder, a rOtor rotatably received within said cylinder, a plurality of vanes carried by said rotor, a pair of diametricallY opposite compression spaces defined between said cylinder and said rotor, compression chambers being defined between adjacent vanes within said compression spaces, a control element being rotatable substantially in response to a difference between low pressure supplied from said suction chamber and control pressure created from high pressure supplied from said discharge pressure chamber for varying compression starting timing in said compression spaces and hence the capacity of said compressor, said control element having a pair of diametrically opposite cut-out portions formed therein, each of said cut-out portions having an upstream end with respect to rotational direction of said rotor, wherein a compression stroke is started in associated one of said compression spaces when each of said vane passes said downstream end of each of said cut-out portion, said control element having a pair of pressure-receiving portions, each defining a first chamber supplied with low pressure from said suction chamber and a second chamber in which said control pressure is created, said pressure-receiving portions each being rotatable in response to said difference between said low pressure within said first chamber and said control pressure within said second chamber, for causing rotation of said control element, said pressure-receiving portions each being arranged slightly downstream of said downstream end of each of said cut-out portions, the improvement comprising capacity-reducing means arranged in one of said pressure-receiving portions and being operable in response to said control pressure for causing pressure within one of said compression chambers in associated one of said compression spaces into immediately following one of said compression chambers when said control element is in such an extreme position as to minimize the capacity of said compressor.

* * * * *